US010816916B2

(12) United States Patent
Ohkubo et al.

(10) Patent No.: US 10,816,916 B2
(45) Date of Patent: Oct. 27, 2020

(54) TONER CONVEYANCE DEVICE WITH A FILM ATTACHED TO A WALL SURROUNDING A CONVEYANCE SCREW

(71) Applicants: Yasuhide Ohkubo, Kanagawa (JP); Kuniyori Takano, Tokyo (JP)

(72) Inventors: Yasuhide Ohkubo, Kanagawa (JP); Kuniyori Takano, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/695,285

(22) Filed: Nov. 26, 2019

(65) Prior Publication Data

US 2020/0174399 A1 Jun. 4, 2020

(30) Foreign Application Priority Data

Nov. 30, 2018 (JP) ..... 2018-224584

(51) Int. Cl.
*G03G 15/08* (2006.01)
*G03G 21/00* (2006.01)
*G03G 21/18* (2006.01)

(52) U.S. Cl.
CPC ..... *G03G 15/0891* (2013.01); *G03G 15/0886* (2013.01); *G03G 15/0889* (2013.01); *G03G 21/1814* (2013.01); *G03G 2221/183* (2013.01)

(58) Field of Classification Search
CPC ... G03G 15/0891; G03G 21/105; G03G 21/10
USPC ..... 399/258, 358, 359
See application file for complete search history.

(56) References Cited

U.S. PATENT DOCUMENTS 8,983,357 B2 * 3/2015 Sakashita et al. ... G03G 21/105 399/358
2015/0132018 A1 5/2015 Sakaya et al.
2015/0132026 A1 5/2015 Yoshida et al.
2015/0286163 A1 10/2015 Yoshida et al.
2015/0346638 A1 12/2015 Mizusawa et al.
2019/0286011 A1 9/2019 Nieda et al.

FOREIGN PATENT DOCUMENTS

JP 2012-053316 3/2012
JP 2017-116953 6/2017

OTHER PUBLICATIONS

U.S. Appl. No. 16/316,523, filed Jul. 13, 2017 Kuniyori Takano, et al.

* cited by examiner

*Primary Examiner* — William J Royer
(74) *Attorney, Agent, or Firm* — Xsensus LLP

(57) ABSTRACT

A toner conveyance device includes a conveying screw including a screw portion helically wound around an axis of rotation of the conveying screw in an axial direction of the conveying screw and a wall having an opening. The wall surrounds the conveying screw with a clearance relative to the conveying screw in a radial direction of the conveying screw. The toner conveyance device further includes a film attached to the wall at a predetermined distance away from an edge of the opening in the axial direction of the conveying screw.

13 Claims, 8 Drawing Sheets

TONER CONVEYANCE DEVICE WITH A FILM ATTACHED TO A WALL SURROUNDING A CONVEYANCE SCREW

CROSS-REFERENCE TO RELATED APPLICATION

This patent application is based on and claims priority pursuant to 35 U.S.C. § 119(a) to Japanese Patent Application No. 2018-224584, filed on Nov. 30, 2018, in the Japan Patent Office, the entire disclosure of which is hereby incorporated by reference herein.

BACKGROUND

Technical Field

Embodiments of the present disclosure generally relate to a toner conveyance device to transport toner and a developing device, a process cartridge, and an image forming apparatus that include the toner conveyance device.

Description of the Related Art

Image forming apparatuses, such as a copier, a printer, and a facsimile machine, include a toner conveyance device to transport toner with a conveying screw.

SUMMARY

Embodiments of the present disclosure describe an improved toner conveyance device that includes a conveying screw including a screw portion helically wound around an axis of rotation of the conveying screw in an axial direction of the conveying screw and a wall having an opening. The wall surrounds the conveying screw with a clearance relative to the conveying screw in a radial direction of the conveying screw. The toner conveyance device further includes a film attached to the wall at a predetermined distance away from an edge of the opening in the axial direction of the conveying screw.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
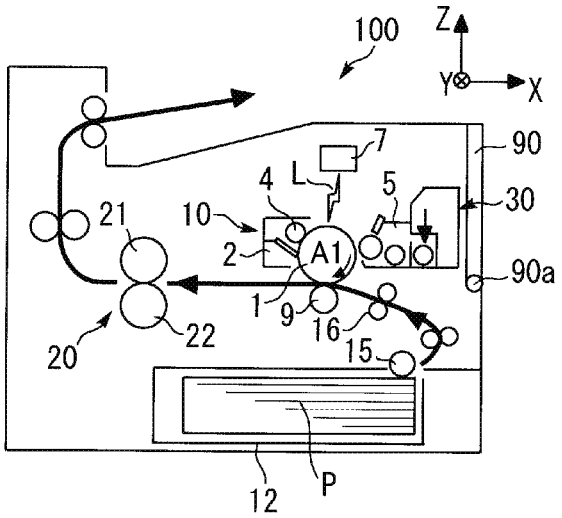
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. It is to be understood that identical or similar reference numerals are assigned to identical or corresponding components throughout the drawings, and redundant descriptions are omitted or simplified below as required.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

With reference to FIG. 1, a configuration and operation of an image forming apparatus 100 is described below.

In FIG. 1, the image forming apparatus 100 that is a printer in the present embodiment includes a photoconductor drum 1 on which a toner image is formed, and an exposure device (writing device) 7. The exposure device 7 irradiates the photoconductor drum 1 with exposure light L based on image data input from an input device such as a personal computer.

The image forming apparatus 100 further includes: a transfer roller 9 to transfer the toner image borne on a surface of the photoconductor drum 1 to a sheet P conveyed to a transfer nip (transfer position); a process cartridge 10 in which the photoconductor drum 1, a charging roller 4, a developing device 5, a cleaning device 2, and a toner conveyance device 6 (see FIG. 2) are united; and a sheet feeder (sheet tray) 12 to accommodate the sheets P such as paper sheets.

The image forming apparatus 100 yet further includes a registration roller pair (timing roller pair) 16 to feed the sheet P toward the transfer nip where the photoconductor drum 1 contacts the transfer roller 9, a fixing device 20 to fix an unfixed image on the sheet P, and a toner container 30 as a powder container. The fixing device 20 includes a fixing roller 21 and a pressure roller 22.

Around the photoconductor drum 1, the charging roller 4, the developing device 5, the cleaning device 2, and the toner conveyance device 6 are disposed. The above components (i.e., the photoconductor drum 1, the charging roller 4, the developing device 5, the cleaning device 2, and the toner conveyance device 6) are united as the process cartridge 10. The replaceable process cartridge 10 as a removable unit is removably installable in the image forming apparatus 100. The process cartridge 10 is replaced with a new process cartridge in a predetermined replacement cycle.

Above the process cartridge 10 (or the developing device 5) as the removable unit, the replaceable toner container 30 as the powder container is detachably attached to the image forming apparatus 100. A toner storage compartment 31 (see FIG. 2) of the toner container 30 stores toner (fresh toner) as powder. The toner is appropriately supplied from the toner container 30 to an interior of the developing device 5. When the toner container 30 runs out of toner (or toner contained in the developing device 5 is depleted), the toner container 30 is replaced with a new toner container. Note that the toner container 30 according to the present embodiment further includes an excess toner collection portion (powder collection portion) 32 (see FIG. 2) in addition to the toner storage compartment (powder storage) 31. The excess toner collection portion 32 is described in detail later.

Figure 2:
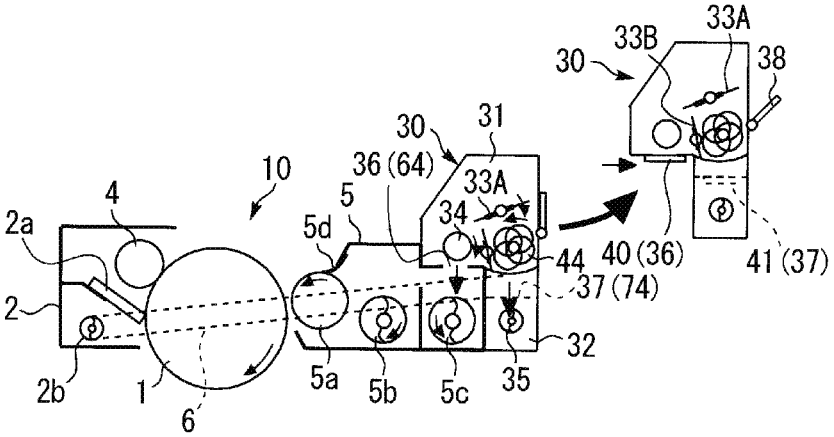
FIG. 2 is a schematic view of a process cartridge and a toner container according to an embodiment of the present disclosure.

Now, a description is given of the image forming operations performed by the image forming apparatus 100 with reference to FIGS. 1 and 2.

With reference to FIG. 1, as image data is transmitted from the input device, such as a personal computer, to the exposure device 7 in the image forming apparatus 100, the exposure device 7 irradiates the surface of the photoconductor drum 1 with the exposure light (a laser beam) L based on the image data.

Meanwhile, the photoconductor drum 1 rotates in a direction indicated by arrow A1 in FIG. 1, that is, a clockwise direction. The charging roller 4 uniformly charges the surface of the photoconductor drum 1 (charging process). As a result, a charging potential is formed on the surface of the photoconductor drum 1. In the present embodiment, the charging potential on the photoconductor drum 1 is approximately −900 V. The charged surface of the photoconductor drum 1 thereafter reaches an irradiation position of the exposure light L. An irradiated portion of the photoconductor drum 1 irradiated with the exposure light L has a latent image potential (about 0 to −100 V) and thus an electrostatic latent image is formed on the surface of the photoconductor drum 1 (exposure process).

The surface of the photoconductor drum 1 bearing the electrostatic latent image thereon then rotates until the surface of the photoconductor drum 1 reaches a position opposite the developing device 5. The developing device 5 deposits toner onto the photoconductor drum 1, and the electrostatic latent image formed on the photoconductor drum 1 is thereby developed into the toner image (developing process).

As illustrated in FIG. 2, the developing device 5 includes a developing roller 5*a*, two development conveying screws 5*b* and 5*c*, and a doctor blade 5*d*. The developing device 5 contains toner (one-component developer). Toner is supplied from a discharge port 36 of the toner container 30 (toner storage compartment 31) to the developing device 5 via an inlet port 64 of the developing device 5 according to consumption of toner in the developing device 5. The two development conveying screws 5*b* and 5*c* stir and mix the supplied toner with the toner contained in the developing device 5 while circulating the toner in a longitudinal direction of the developing device 5, that is, a direction perpendicular to the surface of the paper on which FIG. 2 is drawn. The developing roller 5*a* scoops up a part of the toner transported by the development conveying screw 5*b*. The toner scooped up by the developing roller 5*a* is regulated by the doctor blade 5*d* and reaches a position (development range) opposite the photoconductor drum 1. At that time, the toner on the developing roller 5*a* is rubbed by the doctor blade 5*d* and triboelectrically charged. The toner adheres to the electrostatic latent image on the photoconductor drum 1 in the development range, thereby forming the toner image on the photoconductor drum 1. The developing roller 5*a* and the two development conveying screws 5*b* and 5*c* are rotated in directions indicated by arrows in FIG. 2 by a drive motor included in the image forming apparatus 100.

After the developing process, the surface of the photoconductor drum 1 bearing the toner image thereon reaches the transfer nip (transfer position) between the photoconductor drum 1 and the transfer roller 9. In the transfer nip between the photoconductor drum 1 and the transfer roller 9, a transfer bias, which has a polarity opposite to that of the toner, is supplied from a power source to the transfer roller 9, and the toner image formed on the photoconductor drum 1 is thereby transferred onto the sheet P fed by the registration roller pair 16 (transfer process).

The surface of the photoconductor drum 1 after the transfer process continues to rotate until the surface of the photoconductor drum 1 reaches a position opposite the cleaning device 2. At this position, untransferred toner remaining on the surface of the photoconductor drum 1 is mechanically removed by a cleaning blade 2*a* and collected in the cleaning device 2 (cleaning process) to complete a series of image forming processes on the photoconductor drum 1.

A collection screw 2*b* of the cleaning device 2 transports the untransferred toner collected in the cleaning device 2 to one end of the cleaning device 2 in a width direction of the cleaning device 2 (axial direction of the collection screw 2*b*). The toner conveyance device 6 including a conveying screw 68 (see FIG. 6B) transports the untransferred toner in a diagonally upper right direction in FIG. 2. Thus, the untransferred toner is collected in the excess toner collection portion 32 of the toner container 30 as excess toner from an outlet port 74 of the toner conveyance device 6 via a collection port 37 of the toner container 30.

In the new toner container 30, the toner storage compartment 31 is filled with fresh toner, and the excess toner collection portion 32 is emptied.

A configuration and operation of the toner conveyance device 6 that functions as a conveyor to transport the excess toner is described in further detail later with reference to FIGS. 11 to 15B.

The sheet P is conveyed to the transfer nip (transfer position) between the photoconductor drum 1 and the transfer roller 9 as follows.

First, a feed roller 15 feeds the topmost sheet P of the stack of sheets P accommodated in the sheet feeder 12 toward a conveyance passage.

Thereafter, the sheet P reaches the registration roller pair 16. The sheet P that has reached the registration roller pair 16 is fed to the transfer nip (i.e., the contact position of the transfer roller 9 with the photoconductor drum 1) in synchronization with an entry of the toner image formed on the photoconductor drum 1 into the transfer nip.

After the transfer process, the sheet P passes through the transfer nip (i.e., the position of the transfer roller 9) and reaches the fixing device 20 through the conveyance passage. In the fixing device 20, the sheet P is interposed between the fixing roller 21 and the pressure roller 22. The toner image is fixed on the sheet P by heat applied from the fixing roller 21 and pressure applied from both of the fixing roller 21 and the pressure roller 22. The sheet P having the fixed toner image thereon is discharged from the fixing nip between the fixing roller 21 and the pressure roller 22, ejected from the image forming apparatus 100, and stacked on an output tray to complete the image forming process.

Figure 3A:
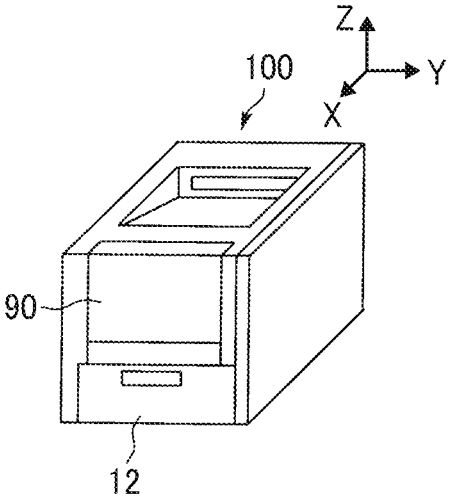
FIG. 3A is a perspective view of the image forming apparatus with a cover closed according to an embodiment of the present disclosure.
Figure 3B:
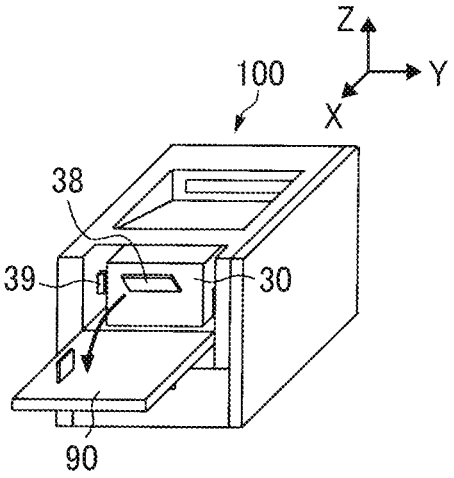
FIG. 3B is a perspective view of the image forming apparatus with the cover open according to an embodiment of the present disclosure.

The image forming apparatus 100 has a plurality of exterior covers as illustrated in FIG. 3A. As illustrated in FIG. 3B, a part of a front exterior cover functions as a cover 90 that is rotatably opened and closed.

More specifically, the cover 90 is secured to the image forming apparatus 100 and hinged around a spindle (a rotation shaft) 90*a* as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

In the present embodiment, when the cover 90 is opened as illustrated in FIG. 3B, the toner container (powder container) 30 is exposed to facilitate installation in and removal from the image forming apparatus 100. By opening the cover 90, the toner container 30 alone (illustrated in FIG. 7) can be replaced with a new toner container, or the toner container 30 together with the process cartridge 10 (the process cartridge 10 and the toner container 30 illustrated in FIG. 4) can be replaced with a new process cartridge and toner container.

Image forming processes (printing operations) described above with reference to FIG. 1 are performed when the cover 90 is closed as illustrated in FIG. 1.

The configuration and operation of the toner container (powder container) 30 according to the present embodiment are described in further detail below.

In the present embodiment, as illustrated in FIG. 2, the toner container 30 as the powder container is detachably attachable to the process cartridge 10. In particular, in the present embodiment, the toner container 30 is detachably attachable to the process cartridge 10 both while the process cartridge 10 is installed in the image forming apparatus 100 and while the process cartridge 10 is removed from the image forming apparatus 100.

As described above with reference to FIG. 3B, the toner container 30 is detachably attachable to the process cartridge 10 installed in the image forming apparatus 100. In other words, the toner container 30 as the powder container is indirectly installable in and removable from the image forming apparatus 100 via the process cartridge 10.

In the present embodiment, the toner container 30 is indirectly installable in and removable from the image forming apparatus 100. In another embodiment, the toner container 30 is directly installable in and removable from the image forming apparatus 100.

Further, the process cartridge 10 is the removable unit that is removably installable in the image forming apparatus 100. In addition to the process cartridge 10, the developing device 5 and other devices can function as the removable units. The toner container 30 can be detachably attachable to a removable unit other than the process cartridge 10.

Figure 4:
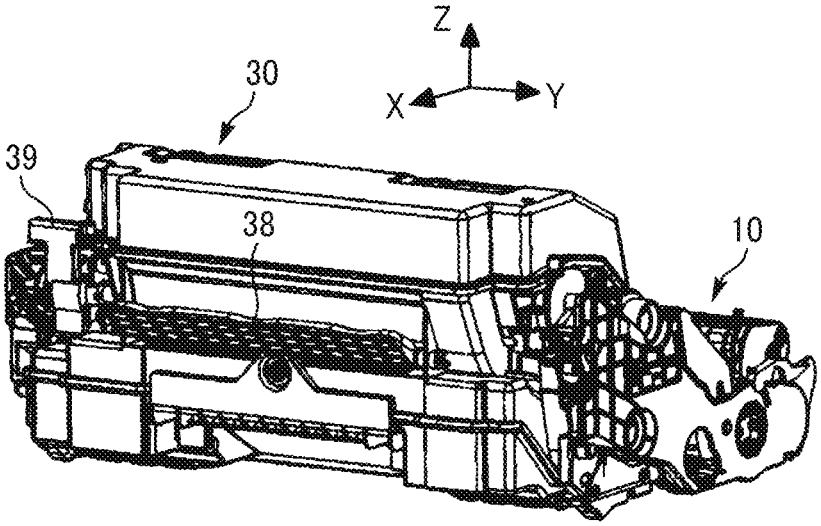
FIG. 4 is a perspective view of the process cartridge to which the toner container is attached.
Figure 5:
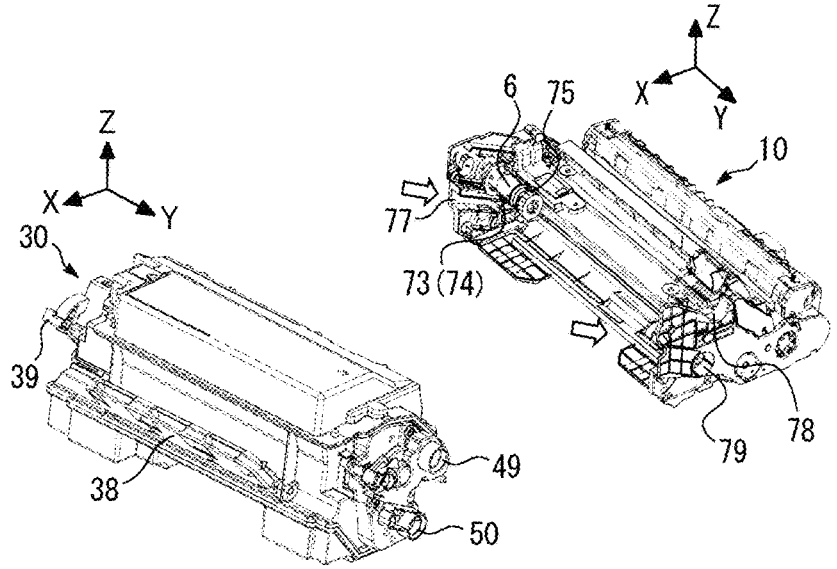
FIG. 5 is a perspective view of the process cartridge from which the toner container is detached.
Figure 6A:
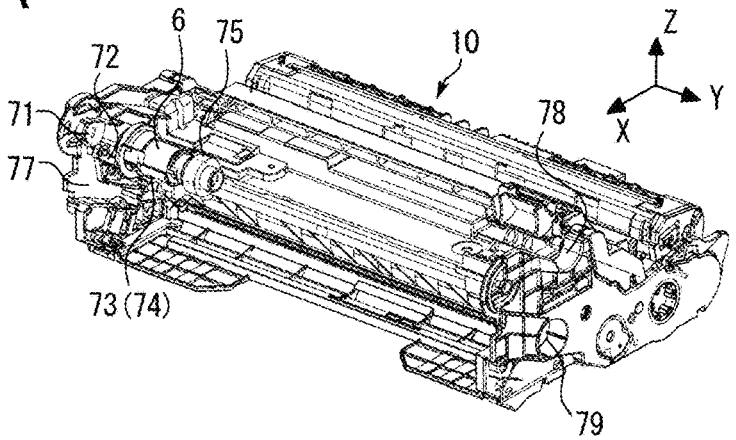
FIGS. 6A and 6B are perspective views of the process cartridge.
Figure 6B:
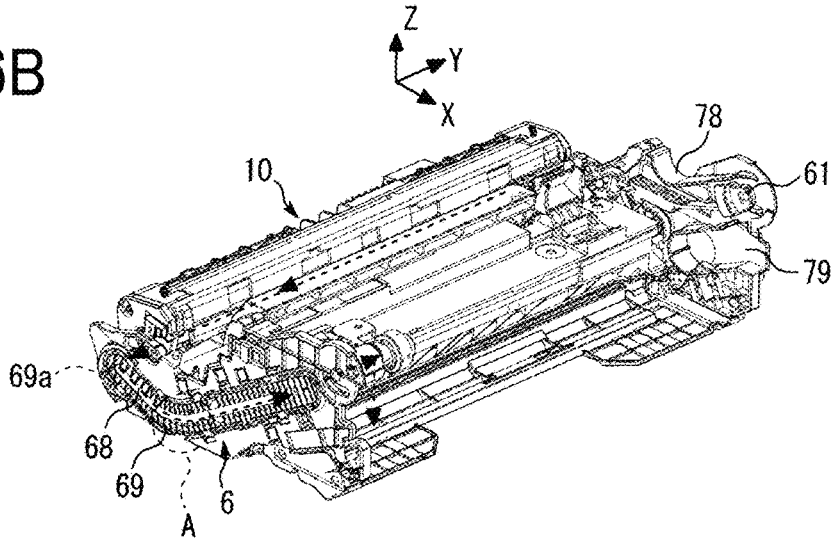
Figure 7:
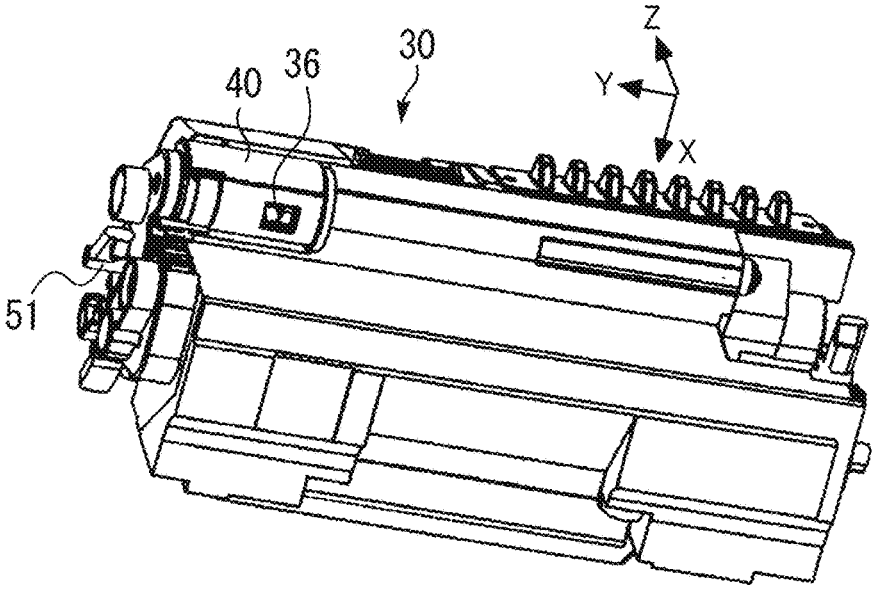
FIG. 7 is a perspective view of the toner container with a first shutter (discharge port) open as viewed from below.
Figure 8:
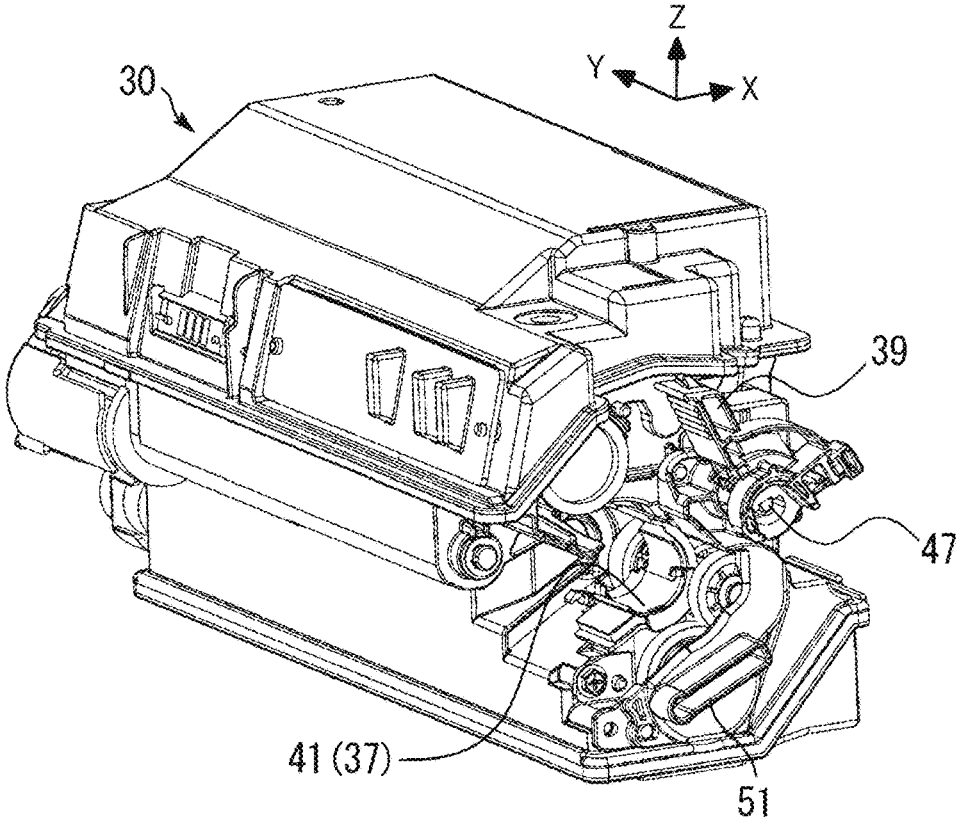
FIG. 8 is a perspective view of the toner container with a second shutter (collection port) closed as viewed from the collection port side.

Furthermore, as illustrated in FIG. 4, a single removable unit (a united component formed of the toner container 30 and the process cartridge 10) in which the toner container 30 is attached to the process cartridge 10 is removably installable in the image forming apparatus 100. As illustrated in FIG. 5, the toner container 30 can be attached to the process cartridge 10, moving in a predetermined direction indicated by blank arrows in FIG. 5. On the other hand, the toner container 30 can be removed from the process cartridge 10, moving in a direction opposite to the predetermined direction. The toner container 30 alone as illustrated in FIGS. 7 and 8 is distributed in the market. The process cartridge 10 alone as illustrated in FIGS. 6A and 6B is similarly distributed in the market.

When the toner container 30 is attached to or detached from the process cartridge 10 (or the image forming apparatus 100), a user grips a handle 38 of the toner container 30 and either pulls out or pushes in the toner container 30. The handle 38 is attached to the front side of the toner container 30 in a direction of detachment (positive X-direction) as illustrated FIGS. 2 to 5. Note that the handle 38 is foldable, so that, when the cover 90 closes in a state in which the toner container 30 is installed in the image forming apparatus 100 with the handle 38 standing up as illustrated in FIGS. 4 and 5, the handle 38 is pushed by the cover 90 in conjunction with movement of the cover 90 from an open state to a closed state, thereby accommodating the handle 38 along an exterior of the toner container 30.

As illustrated in FIG. 5, the process cartridge 10 has multiple guide grooves 77 and 79, and a guide receiver 78, and the toner container 30 includes first and second positioning portions 49 and 50 and a guide 51 (see FIGS. 7 and 8). The first and second positioning portions 49 and 50 and the guide 51 engage the guide receiver 78 and the multiple guide grooves 79 and 77, respectively, so that the toner container 30 can be detachably attached to the process cartridge 10 and properly positioned in the process cartridge 10.

Specifically, the first and second positioning portions (positioning projections) 49 and 50 project from one end face of the toner container 30 in a width direction of the toner container 30 (positive Y-direction). The guide receiver 78 and the guide groove 79 are disposed on one end face of the process cartridge 10 corresponding to the one end face of the toner container 30. The guide 51 projects from the other end face of the toner container 30 (negative Y-direction) and has a rectangular shape which is inclined upward in the positive X-direction. The guide receiver 78 introduces the first positioning portion 49, the guide groove 79 introduces the second positioning portion 50, and the guide groove 77 disposed at the other end face of the process cartridge 10 introduces the guide 51 to attach the toner container 30 to the process cartridge 10. The toner container 30 is positioned in the process cartridge 10 so that the first and second positioning portions 49 and 50 engage dead ends of the guide receiver 78 and the guide groove 79, respectively, and the guide 51 engages a dead end of the guide groove 77.

The first positioning portion 49 is a projection surrounding a coupling that transmits driving force from the image forming apparatus 100 to a first stirrer 33A (see FIGS. 2 and 9) to stir toner. The driving force input to the first stirrer 33A is input to a second stirrer 33B via a gear train, and the first and second stirrers 33A and 33B rotate clockwise in FIG. 9.

Figure 9:
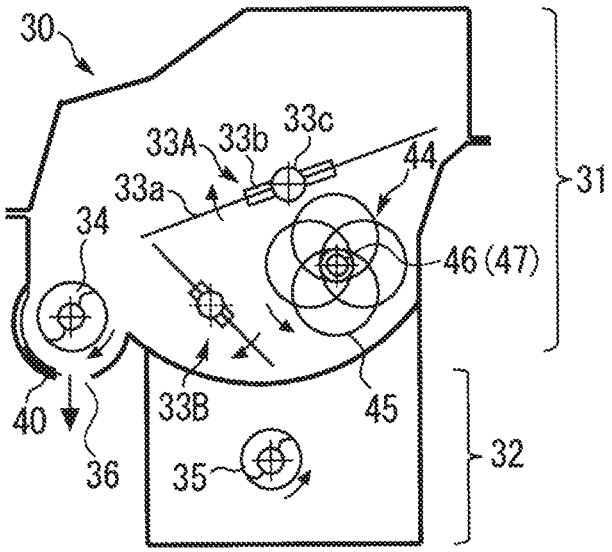
FIG. 9 is a schematic view of an interior of the toner container.
Figure 11:
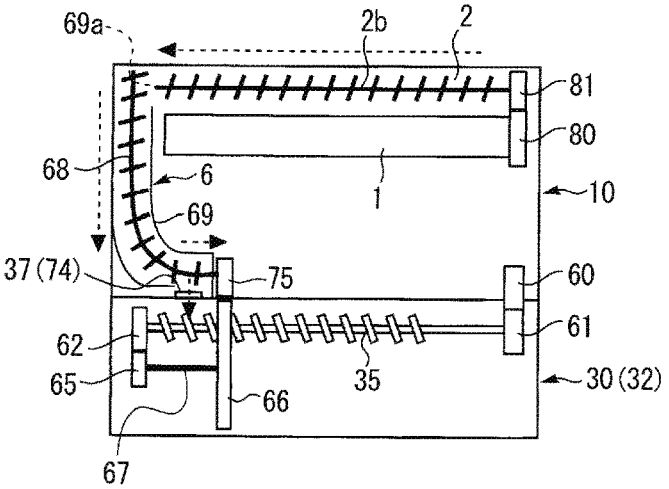
FIG. 11 is a schematic view illustrating a conveyance path of excess toner in the process cartridge and the toner container.

The second positioning portion 50 is a projection surrounding a coupling gear 60 to rotate an excess toner conveying screw 35 (see FIGS. 2, 9, and 11). As described above, input portions to receive the driving force from the image forming apparatus 100 are disposed near (inside) the first and second positioning portions 49 and 50, enabling reliable driving force transmission.

The toner container 30 includes the discharge port 36, the collection port 37, a first container shutter 40, and a second container shutter 41.

With reference to FIGS. 2, 7, and 9, it can be seen that the discharge port 36 of the toner container 30 is an opening to discharge toner stored in the toner container 30 (toner storage compartment 31) to the developing device 5. The discharge port 36 communicates with the inlet port 64 of the developing device 5 when the toner container 30 is attached to the process cartridge 10. The inlet port 64 is an opening disposed above the development conveying screw 5*c*.

Figure 10:
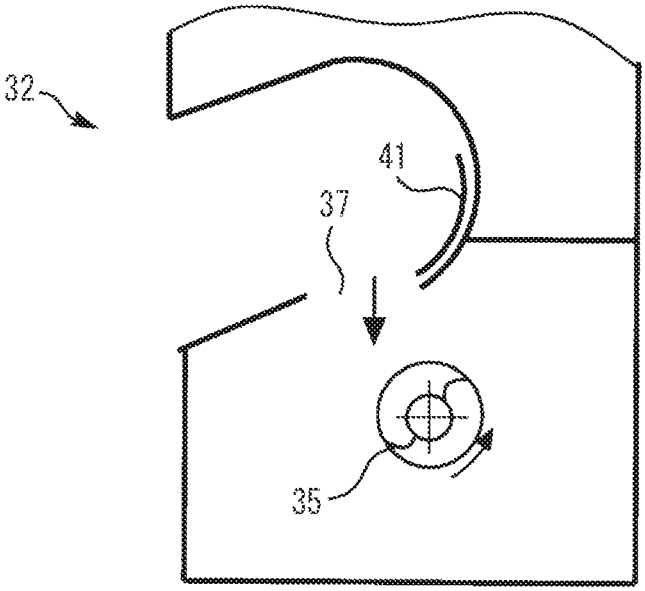
FIG. 10 is a schematic view of an excess toner collection portion of the toner container.

With reference to FIGS. 2, 8, and 10, it can be seen that the collection port 37 of the toner container 30 is an opening to receive untransferred toner as excess toner from the outside of the toner container 30 and to collect the excess toner in the toner container 30. The collection port 37 communicates with the outlet port 74 of the toner conveyance device 6 when the toner container 30 is attached to the process cartridge 10. The outlet port 74 (see FIGS. 5 and 6A) is an opening disposed on a bottom face of a downstream end of the toner conveyance device 6 in a direction of conveyance of the excess toner (hereinafter, referred to as "conveyance direction").

In the toner container 30 according to the present embodiment, the toner storage compartment 31 to store toner to be discharged from the discharge port 36 is separated from the excess toner collection portion 32 to collect the excess toner (powder) received from the collection port 37, by a partition (see FIGS. 2, 9, and 10).

The toner storage compartment 31 further includes a supply screw 34 as a conveyor to rotate clockwise in FIGS. 2 and 9, the first and second stirrers (first and second agitators) 33A and 33B to rotate clockwise in FIGS. 2 and 9, and a coil-shaped stirrer 44. The coil-shaped stirrer 44 is rotated counterclockwise in FIGS. 2 and 9 by contact with the first stirrer 33A.

The supply screw 34 discharges a target amount of toner stored in the toner storage compartment 31 from the discharge port 36 according to a drive timing and rotation duration controlled by a controller.

The first stirrer (first agitator) 33A rotates around a rotation shaft 33*c* in a predetermined direction (clockwise direction in FIGS. 2 and 9 in the present embodiment) to stir toner stored in the toner storage compartment 31 to prevent toner from agglomerating. As illustrated in FIG. 9, the first stirrer 33A includes a flexible member 33*a*, a rigid body 33*b*, and the rotation shaft 33*c*. In the present embodiment, the flexible member 33*a* is made of a plastic sheet and rotates around the rotation shaft 33*c*. The rigid body 33*b* is plate-shaped and disposed across the rotation shaft 33*c* to nip and hold the flexible member 33*a*. The second stirrer 33B has a configuration similar to the first stirrer 33A and rotates in the predetermined direction (clockwise direction in FIGS. 2 and 9 in the present embodiment) to stir toner stored in the toner storage compartment 31 to prevent toner from agglomerating. Both ends of the first and second stirrers 33A and 33B in the direction of axes thereof are rotatably supported by the housing of the toner container 30 via pairs of bearings, respectively.

The coil-shaped stirrer 44 stirs toner in a region of the toner storage compartment 31 where the first stirrer 33A does not sufficiently stir. The coil-shaped stirrer 44 includes a coil 45 including a plurality of divided coil portions and a hollow member (shaft) 46 to hold the coil 45. A piercing shaft 47 is inserted into the hollow member 46. The piercing shaft 47 is one of the components included in a mechanism to open and close the first container shutter 40 and the second container shutter 41 in conjunction with each other.

In the excess toner collection portion 32, the excess toner conveying screw 35 that rotates counterclockwise in FIG. 2 is disposed. The excess toner conveying screw 35 transports excess toner so that the excess toner that flows through the collection port 37 does not accumulate near (under) the collection port 37 and is evenly collected (distributed) in the excess toner collection portion 32.

In the present embodiment, as an operator pivots a lever 39 (see FIG. 8) in a state in which the toner container 30 is attached to the process cartridge 10 (or the image forming apparatus 100), the first container shutter 40 (discharge port 36) and the second container shutter 41 (collection port 37) simultaneously open and close. In addition to the first and second container shutters 40 and 41, the inlet port 64 and the outlet port 74 of the process cartridge 10 also simultaneously open and close. Therefore, open and close failures of the first and second container shutters 40 and 41 and first cartridge shutter and second cartridge shutter 73 are prevented.

When the cover 90 opens in a state in which the toner container 30 is installed in the image forming apparatus 100, the lever 39 is exposed as illustrated in FIG. 3B so that the operator can operate the lever 39.

Here, with reference to FIG. 11, it can be seen that the excess toner collection portion 32 of the toner container 30 in the present embodiment includes the collection port 37, the coupling gear 60, an input gear 61, the excess toner conveying screw 35, a first gear 62, a second gear 65, a second gear rotation shaft 67, a drive gear 66, and the like.

As described above, the collection port 37 is the opening formed in the excess toner collection portion 32 to receive excess toner from the outside of the toner container 30 and to collect the excess toner in the excess toner collection portion 32.

The coupling gear 60 is disposed on one end side in the width direction of the toner container 30 (on the right side in FIG. 11) and receives the driving force transmitted from the outside of the toner container 30.

Specifically, the coupling gear 60 includes a coupling portion and a gear portion integrally formed and is rotatably attached to a stud standing on the side surface on the one end side in the width direction of the toner container 30. The width direction corresponds to an axial direction of the excess toner conveying screw 35 and the left and right direction in FIG. 11. When the process cartridge 10 to which the toner container 30 is attached is installed in the image forming apparatus 100, the coupling portion of the coupling gear 60 meshes with a drive coupling of the image forming apparatus 100 in conjunction with the installation operation of the process cartridge 10. Then, as the drive motor of the image forming apparatus 100 operates and rotates the drive coupling in a predetermined direction, the driving force is transmitted to the coupling gear 60, thereby rotating the coupling gear 60 in the predetermined direction.

The excess toner conveying screw 35 is rotated in the predetermined direction by the driving force transmitted to the coupling gear 60.

Specifically, the excess toner conveying screw 35 includes a screw portion helically wound around an axis of rotation of the excess toner conveying screw 35 and extends across substantially the entire excess toner collection portion 32 in the width direction. The excess toner conveying screw 35 is rotatably held by the housing of the toner container 30 via a bearing. The excess toner conveying screw 35 transports excess toner so that the excess toner that flows through the collection port 37 does not accumulate near (under) the collection port 37 and is evenly collected (distributed) in the excess toner collection portion 32. In the present embodiment, the screw portion of the excess toner conveying screw 35 is not formed on the downstream side that is away from the collection port 37 in the conveyance direction, and the amount of the collected excess toner is evenly distributed and balanced in the excess toner collection portion 32.

Further, the input gear 61 that meshes with the gear portion of the coupling gear 60 is disposed on one end side in the width direction of the excess toner conveying screw 35. As the driving force input to the coupling gear 60 is transmitted to the excess toner conveying screw 35 via the input gear 61, the excess toner conveying screw 35 rotates in the predetermined direction together with the input gear 61, thereby transporting the excess toner.

The first gear 62 is disposed on the other end side in the width direction of the toner container 30 (on the left side in FIG. 11) and rotates together with the excess toner conveying screw 35 and the input gear 61. That is, the input gear 61 is disposed on the one end side and the first gear 62 is disposed on the other end side in the width direction of the excess toner conveying screw 35. Note that an idler gear may be provided between the coupling gear 60 and the input gear 61.

The second gear rotation shaft 67 is disposed on the other end side in the width direction of the toner container 30. The second gear rotation shaft 67 is provided with the second gear 65 to which the driving force is transmitted from the first gear 62 and rotates together with the second gear 65. In other words, the second gear 65 that meshes with the first gear 62 is disposed on the other end side in the width direction of the second gear rotation shaft 67, and the second gear rotation shaft 67 rotates together with the second gear 65.

In addition, the drive gear 66 is disposed at a position away from the second gear 65 on the second gear rotation shaft 67 toward the center of the excess toner collection portion 32 in the width direction. The drive gear 66 is disposed on the second gear rotation shaft 67 between the second gear 65 and the center of the toner container 30 in the width direction and rotates together with the second gear rotation shaft 67, thereby transmitting the driving force to the outside of the toner container 30. The drive gear 66 is disposed between the collection port 37 and the coupling gear 60 in the width direction of the toner container 30. As the driving force input to the coupling gear 60 is transmitted via the input gear 61, the excess toner conveying screw 35, the first gear 62, the second gear 65, and the second gear rotation shaft 67 to the drive gear 66, the drive gear 66 rotates in the predetermined direction. The drive gear 66 is disposed between the collection port 37 and the discharge port 36.

Note that an idler gear may be disposed between the first gear 62 and the second gear 65.

The drive gear 66 rotates together with the second gear rotation shaft 67 and the second gear 65, thereby transmitting the driving force to the outside of the excess toner collection portion 32.

Specifically, the drive gear 66 is disposed in the excess toner collection portion 32 together with the coupling gear 60, the excess toner conveying screw 35, the second gear rotation shaft 67, the input gear 61, the first gear 62, and the second gear 65, to drive the conveying screw 68 that transports untransferred toner contained in the cleaning device 2 disposed in the process cartridge 10 toward the collection port 37. As described above, the drive gear 66 functions as a drive mechanism that transmits the driving force to the conveying screw 68 disposed outside the excess toner collection portion 32 by using the driving force input to the coupling gear 60 from the outside of the excess toner collection portion 32.

More specifically, with reference to FIG. 11, it can be seen that a driven coupling 80 including a gear portion is disposed on one end side in the width direction of the photoconductor drum 1 of the process cartridge 10. When the process cartridge 10 is installed in the image forming apparatus 100, the driven coupling 80 engages a drive coupling of the image forming apparatus 100 in conjunction with the installation operation of the process cartridge 10. Then, as the drive motor of the image forming apparatus 100 operates and rotates the drive coupling in the predetermined direction, the driving force is transmitted to the driven coupling 80, thereby rotating the driven coupling 80 in the predetermined direction (i.e., rotating the photoconductor drum 1 clockwise in FIG. 1).

Meanwhile, a gear 81 that meshes with the gear portion of the driven coupling 80 of the photoconductor drum 1 is disposed on one end side in the width direction of the collection screw 2*b* disposed in the cleaning device 2. As the photoconductor drum 1 is driven to rotate, the collection screw 2*b* also rotates in the predetermined direction, and the untransferred toner collected in the cleaning device 2 is transported in the direction indicated by the broken-line arrow in FIG. 11 from the one end side to the other end side in the width direction of the collection screw 2*b*. The untransferred toner transported to the other end side in the width direction by the collection screw 2*b* flows into the toner conveyance device 6 through an opening 69*a*. Then, the untransferred toner is further transported to the outlet port 74 by the conveying screw 68 disposed in the toner conveyance device 6 and collected in the excess toner collection portion 32 (toner container 30) through the collection port 37 as excess toner.

Thus, the untransferred toner (excess toner) collected by the cleaning device 2 in the process cartridge 10 moves as indicated by the broken-line arrow in FIG. 11 (or FIG. 6B) and is finally collected through the collection port 37 in the excess toner collection portion 32 (toner container 30).

A driven gear 75 that meshes with the drive gear 66 of the excess toner collection portion 32 is attached to one end of the conveying screw 68 disposed in the toner conveyance device 6 (process cartridge 10). The one end is on the outlet port 74 side and downstream in the conveyance direction. The driven gear 75 meshes with the drive gear 66 in conjunction with the attachment operation of the toner container 30 to the process cartridge 10. As described above, the driving force is transmitted from the drive gear 66 of the excess toner collection portion 32 to the driven gear 75, and the conveying screw 68 rotates in the predetermined direction, thereby transporting the excess toner (untransferred toner) toward the outlet port 74 in the toner conveyance device 6. A part of interior of the toner conveyance device 6 is illustrated in cross section in FIG. 6B. The toner conveyance device 6 according to the present embodiment transports the excess toner as indicated by the broken-line arrow in FIG. 6B. That is, the toner conveyance device 6 transports the excess toner from the junction of the cleaning device 2 and the toner conveyance device 6 (i.e., opening 69*a*) in the substantially horizontal direction (the positive X-direction), then obliquely upward, and lastly in the substantially horizontal direction (positive Y-direction) from the other end side toward the center of the process cartridge 10 in the width direction. Further, a conveyance path of the toner conveyance device 6 is bent at a bent portion A. In the present embodiment, the conveying screw 68 is made of a resin material and therefore can be flexibly bent. Therefore, even if the conveying screw 68 is installed in the toner conveyance device 6 having the bent portion A, the excess toner can still be transported satisfactorily.

The driven gear 75 is attached to the end of the conveying screw 68 at a position beyond the outlet port 74 in the conveyance direction. In other words, the driven gear 75 is disposed at the terminal of the conveyance path of excess toner. Accordingly, the driven gear 75 can be driven by the drive gear 66 at a position where the driven gear 75 does not hinder the excess toner from being transported. In addition, the space can be used effectively.

Further, the rotation shaft of the drive gear 66 (i.e., second gear rotation shaft 67) is located below the rotation shaft of the driven gear 75, and the drive gear 66 rotates in a direction in which the driven gear 75 is lifted. That is, the drive gear 66 rotates so that the lowest point of the drive gear 66 rises toward the driven gear 75 side and moves toward the downstream side in the direction of attachment of the toner container 30. As a result, the toner container 30 is pressed downward, and the attitude of the toner container 30 with respect to the process cartridge 10 is stabilized.

The toner conveyance device 6 of the process cartridge 10 (image forming apparatus 100) according to the present embodiment are described in further detail below.

As described above with reference to FIGS. 6B and 11, in the present embodiment, the toner conveyance device 6 transports the untransferred toner, which is transported from the cleaning device 2 by the collection screw 2*b* and flows into the toner conveyance device 6, toward the toner container 30 (excess toner collection portion 32). The toner conveyance device 6 is combined with the process cartridge 10.

Figure 12:
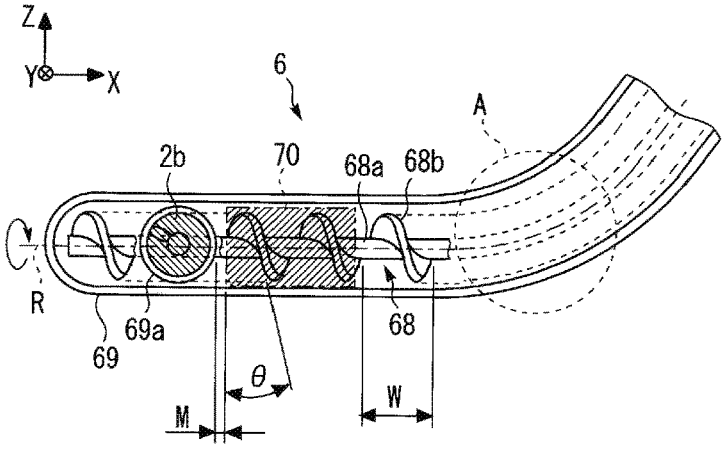
FIG. 12 is a cross-sectional side view of a part of a toner conveyance device of the process cartridge.
Figure 13:
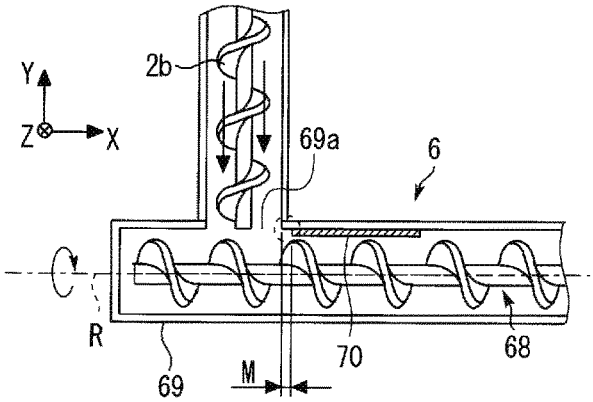
FIG. 13 is a cross-sectional top view of a part of the toner conveyance device.

As illustrated in FIGS. 12 and 13, the toner conveyance device 6 includes the conveying screw 68 and a wall 69. A screw portion 68*b* is helically wound around a shaft 68*a* (axis of rotation R) of the conveying screw 68 in an axial direction of the conveying screw 68. The wall 69 is disposed with a clearance relative to the conveying screw 68 in the radial direction and surrounds the conveying screw 68, thereby forming the conveyance path of the excess toner.

Specifically, in the conveying screw 68, the shaft 68*a* has a diameter of about 1.5 mm, and the screw portion 68*b* helically wound around the shaft 68*a* has an outer diameter of about 8.3 mm. The conveying screw 68 rotates in the predetermined direction around the axis of rotation R of the conveying screw 68. The conveying screw 68 is molded in one piece with a resin material and bendable.

The conveying screw 68 is cantilevered at one end side (a first end side) in the axial direction of the conveying screw 68. Specifically, one end of the shaft 68*a* (on the side to which the driven gear 75 described above with reference to FIG. 11 is attached) is rotatably supported by the case of the process cartridge 10 via a bearing. The driving force is transmitted from the drive gear 66 to the driven gear 75, and the conveying screw 68 rotates in the direction indicated by arrows in FIGS. 12 and 13.

The other end (on a second end side to which the driven gear 75 is not attached) of the conveying screw 68 is a free end as illustrated in FIGS. 12 and 13. Thus, since the conveying screw 68 is rotatably cantilevered, even if a part of the conveying screw 68 is bent by the bent portion A (curved conveyance path) in the conveying path, the conveying screw 68 is hardly broken by torsion.

The wall 69 covers the conveying screw 68 in the circumferential direction and forms the substantially cylindrical conveyance path in the toner conveyance device 6. The inner diameter of the wall 69 is about 9 mm, and the clearance between the screw portion 68*b* of the conveying screw 68 and the wall 69 is about 0.35 mm. The opening 69*a* into which the toner transported from the cleaning device 2 by the collection screw 2*b* flows is disposed in the wall 69. The opening 69*a* is a circular opening having a diameter slightly larger than a diameter of the collection screw 2*b* and disposed in the upstream portion of the substantially cylindrical wall 69 in the conveyance direction to connect the conveyance path with the cleaning device 2. That is, the opening 69*a* is disposed on the free end side that is the second end side in the axial direction of the conveying screw 68. The wall 69 is bent together with the conveying screw 68 at the bent portion A that is away from an edge of the opening 69*a* toward the downstream side in the axial direction.

In the present embodiment, the wall 69 is made of polymer alloy of polycarbonate (PC) and acrylonitrile butadiene styrene (ABS) resin.

The toner that flows into toner conveyance device 6 through the opening 69*a* is transported inside the wall 69 by the conveying screw 68 and finally discharged to the toner container 30 (excess toner collection portion 32). To secure such a conveyance path, the opening 69*a* is disposed at a position downstream from the free end of the conveying screw 68 in the conveyance direction.

As illustrated in FIGS. 12 and 13, in the toner conveyance device 6 according to the present embodiment, a film 70 is attached to the wall 69 at a predetermined distance M away from the edge of the opening 69*a* in the axial direction (i.e., direction along the axis of rotation R).

Specifically, the film 70 is made of polyethylene terephthalate (PET) and has a substantially rectangular shape and a thickness of about 0.11 mm. A surface of the film 70 facing the conveying screw 68 has a smoothness greater than that of an inner surface of the wall 69.

The film 70 is attached to the wall 69 at a position slightly away from the edge of the opening 69*a* (the edge on the downstream side in the conveyance direction) toward the downstream side in the conveyance direction (on the side where the driven gear 75 is disposed and where the bent portion A is formed). In the present embodiment, the film 70 is away from the edge by the distance M of 1 mm or less. As a result, a step due to the film 70 is formed on the wall 69 at a position adjacent to the opening 69*a* on the downstream side in the conveyance direction.

Note that, in the present disclosure, a state in which "the film 70 is attached to the wall 69 at the predetermined distance M away from the edge of the opening 69*a* in the axial direction" includes a state in which "only the extreme downstream portion of the edge of the circular opening 69*a* is in contact with the film 70 (i.e., a state in which the distance M in FIG. 12 is 0)". That is, the film 70 is attached to the wall 69 so that the film 70 does not overlap with the opening 69*a* and not the entire edge of the film on a side nearest the opening 69*a* contacts the edge of the opening 69*a*.

Thus, the film 70 is disposed in the vicinity of the opening 69*a* of the wall 69 (at a position adjacent to the opening 69*a* in the axial direction), thereby preventing the screw portion 68*b* of the conveying screw 68 from contacting the edge of the opening 69*a*. Therefore, the loud sound is not generated.

Figure 15A:
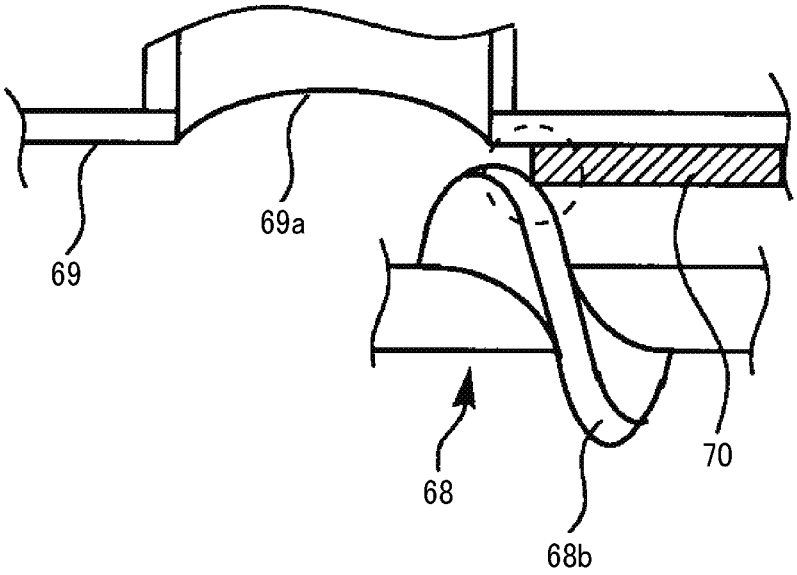
FIG. 15A is a schematic view illustrating a state in which a conveying screw of the toner conveyance device contacts the film.
Figure 15B:
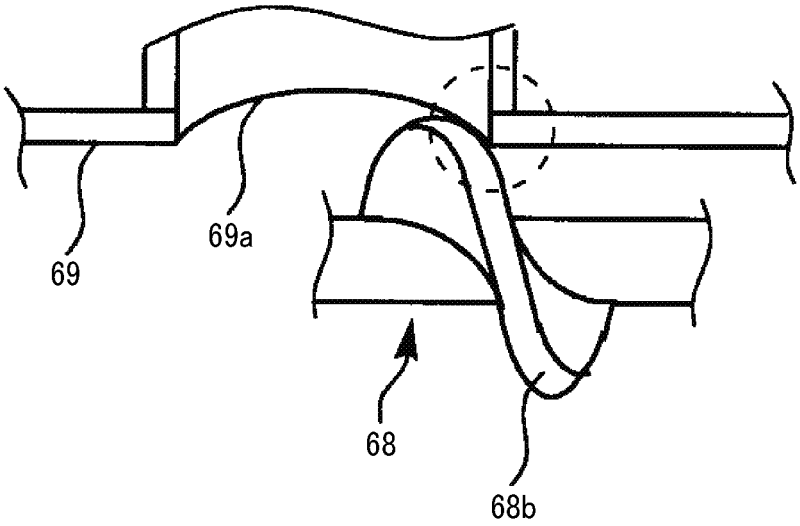
FIG. 15B is a schematic view illustrating a state in which the conveying screw contacts an edge of an opening of the wall.

Specifically, as illustrated in FIG. 15B, without the film 70, the screw portion 68*b* of the conveying screw 68 contacts the edge of the opening 69*a* in a wide range (substantially line contact). Accordingly, a large sliding resistance is generated, causing loud noise (noise). In particular, since the opening 69*a* is disposed on the free end side of the conveying screw 68 and the conveying screw 68 is bent, the screw portion 68*b* of the conveying screw 68 is likely to contact the edge of the opening 69*a* without the film 70 due to runout of the conveying screw 68 during rotation.

In contrast, in the present embodiment, since the film 70 is disposed in the vicinity of the opening 69*a*, as illustrated in FIG. 15A, the screw portion 68*b* of the conveying screw 68 does not directly contact the edge of the opening 69*a* in line contact. The screw portion 68*b* contacts the edge of the film 70 on the side nearest the opening 69*a* in a narrow range (substantially point contact). Further, the surface of the film 70 has a high smoothness. Therefore, even if the conveying screw 68 contacts the film 70, the above-described loud noise (noise) is hardly generated.

Here, in the present embodiment, the above-described "predetermined distance M" (the distance in the axial direction between the opening 69*a* and the film 70) is shorter than a pitch W of the screw portion 68*b* (i.e., M<W).

With this configuration, even if runout of the conveying screw 68 occurs, the screw portion 68*b* of the conveying screw 68 does not contact the edge of the opening 69*a* but is likely to contact the edge of the film 70 as illustrated in FIG. 15A. Therefore, the effect of reducing the noise described above is reliably attained.

With reference to FIG. 12, in the present embodiment, it can be seen that the angle between the edge of the film 70 on the side nearest the opening 69*a* and the axis of rotation R of the conveying screw 68 is approximately 90 degrees. Further, the range in which the film 70 is attached is larger than a range including at least the opening 69*a* in the circumferential direction on the inner surface of the cylindrical wall 69.

With this configuration, even if runout of the conveying screw 68 occurs, the screw portion 68*b* of the conveying screw 68 does not contact the edge of the opening 69*a* but is likely to contact the edge of the film 70 as illustrated in FIG. 15A. Therefore, the effect of reducing the noise described above is reliably attained.

With reference to FIG. 12, in the present embodiment, it can be seen that an angle θ between the edge of the film 70 on the side nearest the opening 69*a* and an outer peripheral of the screw portion 68*b* ranges from 30 to 120 degrees.

With this configuration, as illustrated in FIG. 15A, the screw portion 68*b* is likely to contact the edge of the film 70 in point contact while maintaining the helical shape of the screw portion 68*b* related to the ability to transport toner. Therefore, the effect of reducing the noise described above is reliably attained.

Note that, in the present embodiment, the angle θ is 30 degrees.

In addition, with reference to FIG. 12, in the present embodiment, it can be seen that the film 70 is attached to the wall 69 between the opening 69*a* and the bent portion A. That is, the film 70 is attached to the wall 69 between the end (free end) of the conveying screw 68 and the bent portion A.

With this configuration, since the film 70 is attached to the wall 69 without bending, enabling the film 70 to reliably adhere to the wall.

In the present embodiment, a length of the film 70 is about 14 mm in the axial direction.

Figure 14A:
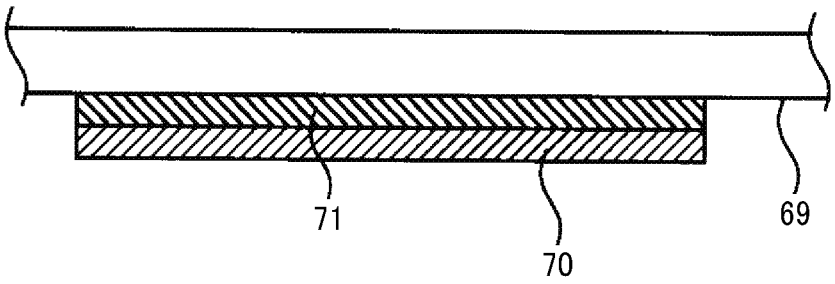
FIGS. 14A and 14B are schematic views of a film attached to a wall of the toner conveyance device.

Here, in the present embodiment, as illustrated in FIG. 14A, the film 70 is attached to the wall 69 with an adhesive 71. The adhesive 71 has a function of adsorbing an impact and attenuating vibration in addition to the function of bonding two things. Therefore, a portion (intermediate layer) where the adhesive 71 is interposed functions as a damper. Therefore, even if the conveying screw 68 contacts the film 70, the impact at that time is absorbed by the adhesive 71, thereby further reducing the generation of sound.

Figure 14B:
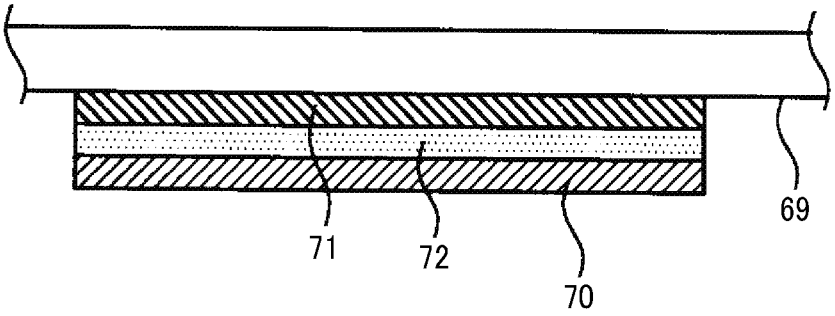

Note that, in the present embodiment, as illustrated in FIG. 14B, the film 70 can also be attached to the wall 69 with the adhesive 71 via a foamed polyurethane sheet 72 as the damper. In such a case, in addition to the adhesive 71, the foamed polyurethane sheet 72 also functions as the damper, and thus the above-described effect is further attained.

In the present embodiment, the conveying screw 68 contacts the wall 69 or the film 70 with force of 40 gf or less when the conveying screw 68 is not rotating.

As described above, since the conveying screw 68 is cantilevered and bent, the conveying screw 68 is likely to contact the wall 69. At that time, the force of contacting the wall 69 becomes weaker when the conveying screw 68 is made of a soft material. If the contact force is 40 gf or less, no annoying sound is generated when the conveying screw 68 contacts the wall 69 or the film 70.

In the present embodiment, the material of the conveying screw 68 is chosen so that the contact force described above is about 18 gf.

As described above, the toner conveyance device 6 according to the above-described embodiments includes the conveying screw 68 including the screw portion 68*b* helically wound around the axis of rotation of the conveying screw 68 in the axial direction of the conveying screw 68, and the wall 69 surrounding the conveying screw 68 with the clearance relative to the conveying screw 68 in the radial direction of the conveying screw 68. The wall 69 has the opening 69*a*. The toner conveyance device 6 further includes the film 70 attached to the wall 69 at the predetermined distance M away from the edge of the opening 69*a* in the axial direction of the conveying screw 68.

This configuration can prevent the screw portion 68*b* of the conveying screw 68 from contacting the edge of the opening 69*a* formed in the wall 69 that surrounds the conveying screw 68, thereby reducing the generation of loud noise.

Therefore, the present disclosure can provide a toner conveyance device, a developing device, a process cartridge, and an image forming apparatus that minimize the generation of loud noise when a screw portion of a conveying screw contacts an edge of an opening disposed in a wall surrounding the conveying screw.

In the above-described embodiments, the present disclosure is applied to the process cartridge 10 as a single unit including the photoconductor drum 1 (image bearer), the charging roller (charger) 4, the developing device 5, the cleaning device 2, and the toner conveyance device 6. However, the present disclosure is not limited to the embodiments described above and can be applied to the image forming apparatus 100 in which the above-described devices (i.e., the photoconductor drum 1 as the image bearer, the charging roller 4, the developing device 5, the cleaning device 2, and the toner conveyance device 6) are removably installed as a single unit, respectively.

In such configurations, effects similar to those of the above-described embodiments are also attained.

It is to be noted that the term "process cartridge" used in the present disclosure means a removable unit including an image bearer and at least one of a charger to charge the image bearer, a developing device to develop latent images on the image bearer, and a cleaning device to clean the image bearer that are united together, and is designed to be removably installed as a united part in the image forming apparatus.

In the above-described embodiments, the present disclosure is applied to the toner conveyance device 6 included in the image forming apparatus 100 that performs monochrome image formation. Alternatively, the present disclosure may also be applied readily to a toner conveyance device included in a color image forming apparatus.

In the above-described embodiments, the toner conveyance device 6 is installed in the process cartridge 10. However, the toner conveyance device is not limited to such a configuration, and for example, the toner conveyance device can be installed in a developing device, a cleaning device, or an excess toner receptacle.

In the above-described embodiments, the present disclosure is applied to, but not limited to, the toner conveyance device 6 to transport excess toner. The present disclosure can be applied to, for example, a toner conveyance device to transport fresh toner, a toner conveyance device to transport recycle toner, and a toner conveyance device to transport a two-component developer including toner and carrier.

Further, in the above-described embodiments, the film 70 is disposed in the vicinity of the opening 69*a* through which toner flows into the toner conveyance device 6. Alternatively, a film can be disposed in the vicinity of an opening through which toner flows out of the toner conveyance device 6.

Further, in the above-described embodiments, the film 70 is attached to a part of the wall 69 in the circumferential direction, which is a range of a substantially half circumference. Alternatively, a film can be attached to the entire wall 69 in the circumferential direction.

All of the cases described above exhibit effects similar to those of the above-described embodiments.

The above-described embodiments are illustrative and do not limit the present disclosure. It is therefore to be understood that within the scope of the present disclosure, the embodiments described above may be practiced otherwise than as specifically described herein. Thus, for example, the number, position, and shape of the components described above are not limited to those embodiments described above and may be determined as desired to implement the present disclosure.

What is claimed is:

1. A toner conveyance device comprising:

a conveying screw including a screw portion helically wound around an axis of rotation of the conveying screw in an axial direction of the conveying screw;

a wall surrounding the conveying screw with a clearance relative to the conveying screw in a radial direction of the conveying screw, the wall having an opening; and a film attached to the wall at a predetermined distance away from an edge of the opening in the axial direction of the conveying screw.

2. The toner conveyance device according to claim 1, wherein the predetermined distance is shorter than a pitch of the screw portion.

3. The toner conveyance device according to claim 1, wherein a surface of the film facing the conveying screw has a smoothness greater than a smoothness of an inner surface of the wall.

4. The toner conveyance device according to claim 1, wherein an angle of an edge of the film on a side nearest the opening and the axis of rotation of the conveying screw is 90 degrees.

5. The toner conveyance device according to claim 1, wherein an angle of an edge of the film on a side nearest the opening and an outer peripheral of the screw portion ranges from 30 to 120 degrees.

6. The toner conveyance device according to claim 1, wherein the conveying screw and the wall are bent in a bent portion away from the edge of the opening, and wherein the film is attached to the wall between the opening and the bent portion.

7. The toner conveyance device according to claim 1, wherein the conveying screw is cantilevered at one end in the axial direction of the conveying screw, and the opening is disposed on a side of other end, which is a free end of the conveying screw, in the axial direction of the conveying screw.

8. The toner conveyance device according to claim 1, wherein the film is attached to the wall with an adhesive.

9. The toner conveyance device according to claim 1, wherein the film is attached to the wall via a damper with an adhesive.

10. The toner conveyance device according to claim 1, wherein the conveying screw is configured to contact the wall or the film with force of 40 gf or less when the conveying screw is not rotating.

11. A developing device comprising the toner conveyance device according to claim 1, wherein the developing device is configured to contain toner and develop a latent image on an image bearer into a toner image.

12. A process cartridge comprising the toner conveyance device according to claim 1, wherein the process cartridge is configured to be removably installable in an image forming apparatus.

13. An image forming apparatus comprising the toner conveyance device according to claim 1.

* * * * *